United States Patent [19]

Scheibner

[11] 4,363,345

[45] Dec. 14, 1982

[54] RECLOSABLE CONTAINER

[75] Inventor: Gerald H. Scheibner, Downers Grove, Ill.

[73] Assignee: Union Carbide Corporation, Danbury, Conn.

[21] Appl. No.: 322,722

[22] Filed: Nov. 18, 1981

Related U.S. Application Data

[63] Continuation of Ser. No. 155,233, Jun. 2, 1980, abandoned.

[51] Int. Cl.[3] ..... B65D 33/24
[52] U.S. Cl. ..... 150/3; 24/201 C
[58] Field of Search ..... 150/3; 24/201 C

[56] References Cited

U.S. PATENT DOCUMENTS

| | | | |
|---|---|---|---|
| 3,347,298 | 10/1967 | Ausnit et al. | 150/3 |
| 3,371,696 | 3/1968 | Ausnit | 150/3 |
| 3,780,781 | 12/1973 | Uramoto | 150/3 |
| 3,827,472 | 8/1974 | Uramoto | 150/3 |
| 4,186,786 | 3/1980 | Kirkpatrick | 150/3 |
| 4,191,230 | 3/1980 | Ausnit | 150/3 |

*Primary Examiner*—Donald F. Norton
*Attorney, Agent, or Firm*—Real J. Grandmaison; John C. Lefever

[57] ABSTRACT

A reclosable container features ridges near the opening of the container to provide improved gripping of the container by the user during the opening and loading of the container.

14 Claims, 8 Drawing Figures

RECLOSABLE CONTAINER

This application is a continuation of our prior U.S. application Ser. No. 155,233 Filing Date June 2, 1980, now abandoned.

This invention relates to a reclosable container, and particularly, a container having a closure fastening device including two closure profiles operable for being interlocked continuously over a predetermined length.

Generally, containers having closure devices are well known in the art. U.S. Pat. No. 4,186,786 to Kirkpatrick is an example of the type of container which can be improved by the instant invention, and the disclosure of this patent is incorporated herein by reference.

The use of flexible reclosable containers is widespread and is often used in homes for the storage of various items such as food. It is not uncommon that the opening of an occluded closure fastening device on a container is made somewhat more difficult by the smoothness of the container sidewalls in the vicinity of the opening of the container. This is particularly a problem if the user has slippery fingers as a result of handling greasy food or the like. Furthermore, the smoothness of the sidewalls near the opening of the container makes it somewhat more difficult to hold the open container during loading.

U.S. Pat. No. 3,371,696 to Ausnit teaches the use of a raised bead at the edge of one sidewall at the opening of the container to improve the accessibility of the container opening. This patent, however, does not teach or suggest a construction which eliminates the gripping problem, especially for a user with slippery fingers.

The instant invention surprisingly improves the ease with which a reclosable container can be opened by positioning ridges near the reclosable end of the container to provide the best user convenience. The ridges also permit the user to hold the open container during loading with less effort as compared to the prior art containers.

In its broadest form, the invention is a container having a reclosable end, comprising flexible first and second sidewalls, and a closure fastening device including first and second closure profiles positioned on respective first and second sidewalls and operable for being occluded and disengaged with respect to each other to close and open the container; and features the first sidewall extending beyond the end edge of the second sidewall at the reclosable end, first and second ridges spaced apart from each other on the surface of the first sidewall and arranged substantially parallel to the first closure profile, the first ridge being positioned near the end edge of the first sidewall, and the second ridge being positioned substantially opposite the end edge of the second sidewall with respect to the container when the closure profiles are occluded, and a third ridge on the surface of the second sidewall and arranged substantially parallel to the second closure profile, the third ridge positioned near the end edge of the second sidewall.

In a preferred embodiment, the first and second ridges are on the inside surface of the first sidewall and the third ridge is on the inside surface of the second sidewall. Preferably, the third ridge is positioned substantially opposite the region of the first sidewall bordered by the second ridge and the first closure profile with respect to the container when the closure profiles are occluded.

Other preferred embodiments feature the sidewalls being transparent or translucent or opaque and the ridges being colored to be easily recognized visually with respect to the sidewalls.

Yet another preferred embodiment features each of the ridges having a polygonal cross section with well defined vertices. Preferably, the polygonal cross section is trapezoidal or triangular. The trapezoidal and triangular cross sections have been found to be the most convenient for users especially when the ridges are located on the inside surfaces of the sidewalls.

The invention accordingly comprises the features of construction, combination of elements and arrangement of parts which will be exemplified in a construction hereinafter set forth.

For a fuller understanding of the nature and objects of the invention, reference should be had to the following detailed description, taken in connection with the accompanying drawings, in which.

FIGS. 4A, 4B, 4C, 4D, and 4E are side elevational views on an enlarged scale of portions of containers according to the invention.

In carrying the invention into effect, several embodiments have been selected for illustration in the accompanying drawings and for description in this specification, reference being had to the FIGS. 1, 2, 3, 4A, 4B, 4C, 4D, and 4E.

Figure 1:
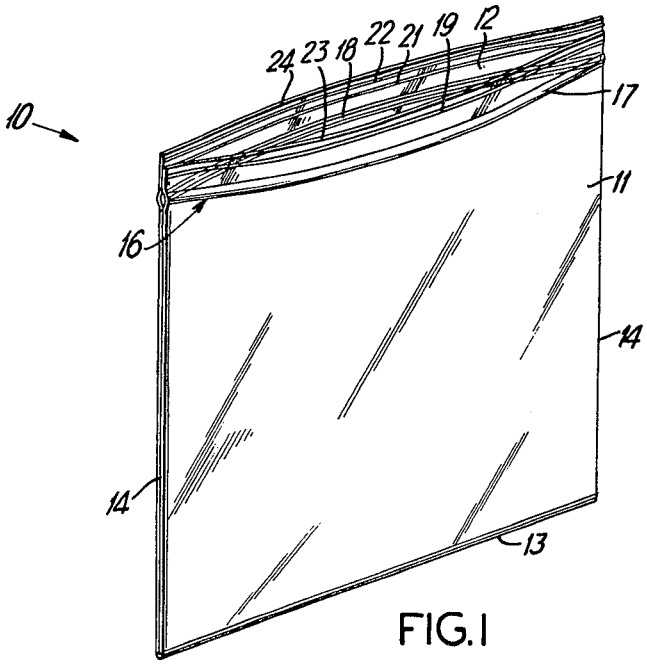
FIG. 1 is a perspective view of an opened container in accordance with the invention.

FIG. 1 shows a perspective view of an opened container 10. The container 10 has sidewalls 11 and 12 which are typically thin, flexible, transparent plastic film which has been folded along bottom edge 13 and heat sealed along vertical side edges 14 to define a pouch.

The container 10 includes a closure fastening device 16 such as described in the aforementioned U.S. Pat. No. 4,186,786. The closure device 16 includes closure profiles 17 and 18 which can be occluded and disengaged with respect to each other for closing and opening the container 10.

Figure 2:
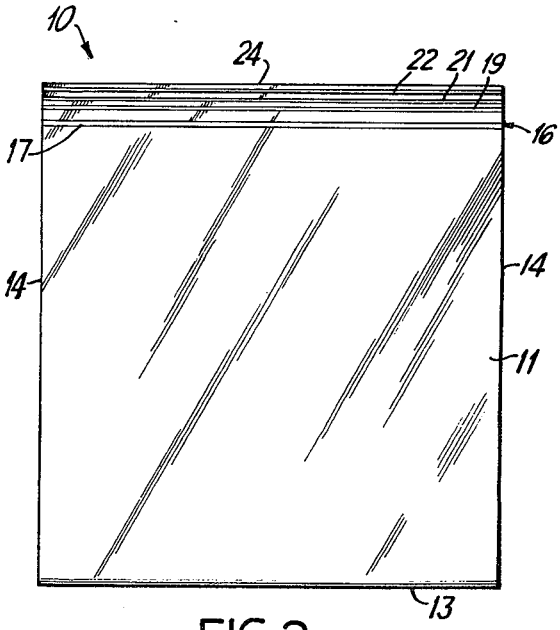
FIG. 2 is a front elevational view of the container of FIG. 1 with the closure fastening device occluded.

It can be seen from FIG. 2 that the use of transparent sidewalls 11 and 12 results in the visual recognition that there are three ridges 19, 21, and 22, above the closure fastening device 16.

Figure 3:
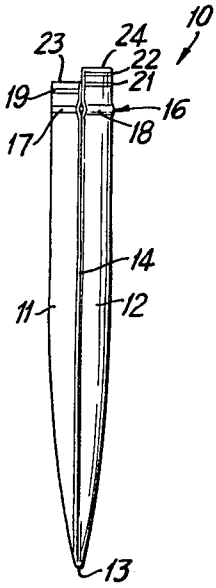
FIG. 3 is a side elevational view of the container of FIG. 1.

FIG. 3 shows the relative positions of the ridges 19, 21, and 22 with respect to the top edges 23 and 24 as well as the closure profiles 17 and 18.

FIGS. 4A, 4B, 4C, 4D, and 4E show various polygonal cross sections of ridges 19, 21, and 22 in positions on the inside and outside surfaces of the sidewalls 11 and 12. The ridges should be above the closure profiles 17 and 18 towards the top edges 23 and 24 for satisfactory performance in practicing the invention.

Preferably, the ridges 19, 21, and 22 are located on the inside surfaces of the sidewalls 11 and 12.

Figure 4A:
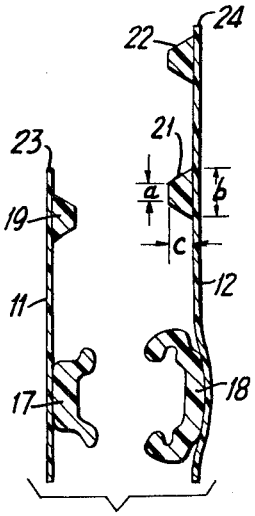
Figure 4B:
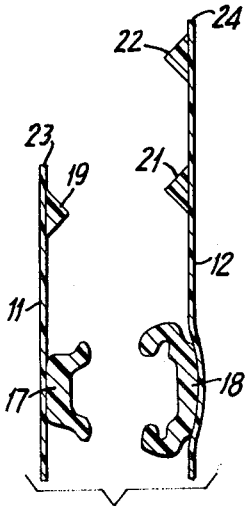
Figure 4C:
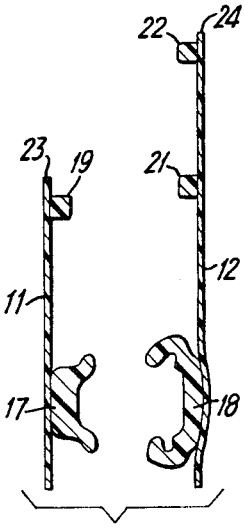
Figure 4D:
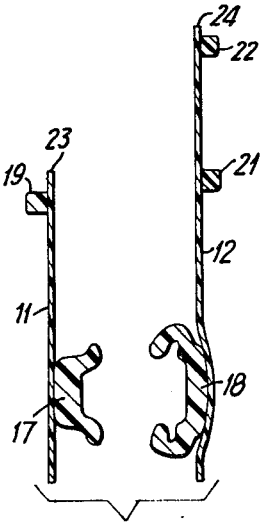
Figure 4E:
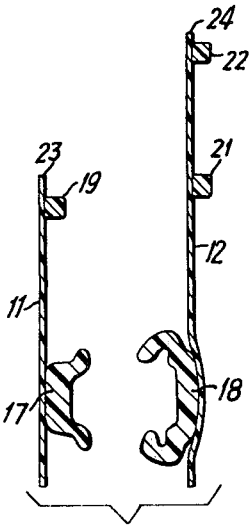

In FIG. 4A, the ridges 19, 21, and 22 have trapezoidal cross sections with the typical dimensions as follows. The width "a" is from about 0 to about 0.100 inch, the width "b" is from about 0.005 to about 0.100 inch, and the height "c" is from about 0.010 to about 0.050 inch. FIG. 4B shows the ridges 19, 21, and 22 as having triangular cross sections which corresponds to the width "a" of FIG. 4A being about zero. FIG. 4C shows the ridges as having rectangular cross sections which correspond to the widths "a" and "b" of FIG. 4A being substantially equal to and parallel to each other. FIGS. 4D and 4E are other arrangements of ridges 19, 21, and 22, having polygonal cross sections.

It is not necessary for all of the ridges 19, 21, 22 to have the same corresponding dimensions. In fact, the best mode as will be described features ridges 21 and 22 being about the same but being different from the ridge 19.

The best mode embodiment of the invention is as follows.

The sidewalls 11 and 12 are clear, flexible, polyethylene film and the closure fastening device 16 is the type disclosed in the aforementioned U.S. Pat. No. 4,186,786.

The container 10 width is about $10\frac{1}{2}$ inches and the height is about $11\frac{3}{4}$ inches. The closure fastening device 16 is about $\frac{5}{8}$ inch below the top edge 24. The ridge 19 is less than about $\frac{1}{8}$ inch below the top edge 23 and the ridge 21 is about $\frac{1}{8}$ inch below the ridge 22. The top edge 23 is at substantially the same level as the ridge 21 when the closure fastening device 16 is occluded. The ridge 22 is about 1/16 inch below the top edge 24.

The ridges 21 and 22 have dimensions "a" and "b" about 0.015 inch each and dimension "c" of about 0.025 inch. The ridge 19 has dimension "a" of about 0.035 inch, dimension "b" of about 0.045 inch, and dimension "c" of about 0.030 inch.

The ridges 19, 21, and 22 are colored yellow, closure profile 18 is clear, and closure profile 17 is colored blue.

The operation of the container according to the invention is as follows.

A user in the process of opening the container 10 with occluded profiles 17 and 18 can easily separate the top edges 23 and 24 because the sidewall 12 is longer than the sidewall 11, and the ridge 22 is practically automatically engaged by the thumb of the user if the user strokes his thumb across the top edges 23 and 24. The relatively small spacing between the ridges 21 and 22 enables the user to engage both the ridges 21 and 22 as a result of this stroking of the top edges 23 and 24. The ridges 21 and 22 result in an excellent gripping surface even for a user with slippery fingers. The ridge 19 results in an excellent gripping surface on the opposing surface.

The user proceeds to separate the top edges 23 and 24 from each other by spreading them apart to disengage the closure profiles 17 and 18 from each other.

The opening of the container 10 involves three operative forces which are of interest. In addition to the spreading force, the user exerts squeezing forces on the ridges 19, 21 and 22 to produce frictional forces which will prevent the sidewalls 11 and 12 from slipping from the user's fingers.

In addition, the user exerts squeezing forces on the ridges 19, 21 and 22 to prevent the container 10 from slipping from the user's fingers when the container 10 is being loaded.

The ridges 19, 21, and 22 drastically reduce the squeezing forces needed by the user especially if the user has slippery fingers.

I wish it to be understood that I do not desire to be limited to the exact details of construction shown and described, for obvious modifications will occur to a person skilled in the art.

Having described the invention, what I claim as new and desire to be secured by Letters Patent is as follows:

What is claimed:

1. In a container having a reclosable end, comprising flexible first and second sidewalls, and a closure fastening device including first and second closure profiles positioned on respective first and second sidewalls and operable for being occluded and disengaged with respect to each other to close and open said container, said first sidewall extending beyond the end edge of said second sidewall at said reclosable end; the improvement which comprises:

first and second ridges spaced apart from each other on the surface of said first sidewall and arranged substantially parallel to said first closure profile;

said first ridge being positioned near the end edge of said first sidewall, and said second ridge being positioned substantially opposite the end edge of said second sidewall when said closure profiles are occluded; and a third ridge on the surface of said second sidewall and arranged substantially parallel to said second closure profile;

said third ridge being positioned near the end edge of said second sidewall.

2. The container of claim 1 wherein said first and second ridges are on the inside surface of said first sidewall and said third ridge is on the inside surface of said second sidewall.

3. The container of claim 1 wherein said third ridge is positioned substantially opposite the region of said first sidewall bordered by said second ridge and said first closure profile when said closure profiles are occluded.

4. The container of claim 1 wherein said sidewalls are transparent and said ridges are colored to be easily recognized visually with respect to said sidewalls.

5. The container of claim 1 wherein said sidewalls are translucent and said ridges are colored to be easily recognized visually with respect to said sidewalls.

6. The container of claim 1 wherein said sidewalls are opaque and said ridges are colored to be easily recognized visually with respect to said sidewalls.

7. The container of claim 1 wherein said ridges have polygonal cross sections.

8. The container of claim 1 wherein said ridges have trapezoidal cross sections.

9. The container of claim 1 wherein said ridges have rectangular cross sections.

10. The container of claim 1 wherein said ridges have triangular cross sections.

11. The container of claim 1 wherein said ridges have trapezoidal cross sections having a width at the respective connecting sidewall of from about 0.005 to about 0.100 inch, a width opposite the respective connecting sidewall of from about 0 to about 0.100 inch, and a height of from about 0.010 to about 0.050 inch.

12. The container of claim 4 wherein said ridges are colored yellow, and said sidewalls are transparent.

13. The container of claim 12 wherein one closure profile is blue and the other closure profile is transparent.

14. In a container having a reclosable end, comprising flexible first and second sidewalls, and a closure fastening device including first and second closure profiles positioned on respective first and second sidewalls and operable for being occluded and disengaged with respect to each other to close and open said container, said first sidewall extending beyond the end edge of said second sidewall at said reclosable end; the improvement which comprises:

first and second ridges spaced apart from each other on the inside surface of said first sidewall and arranged substantially parallel to said first closure profile;

said first ridge being positioned near the end edge of said first sidewall, and said second ridge being positioned substantially opposite the end edge of said second sidewall when said closure profiles are occluded; and a third ridge on the inside surface of said second sidewall and arranged substantially parallel to said second closure profile;

said third ridge being positioned near the end edge of said second sidewall.

* * * * *